US005737679A

United States Patent [19]

Uehara et al.

[11] Patent Number: 5,737,679

[45] Date of Patent: Apr. 7, 1998

[54] FIXING APPARATUS HAVING PRESSING MEMBERS

[75] Inventors: Yasuhiro Uehara; Mitsuhiro Matsumoto, both of Nakai-machi, Japan

[73] Assignee: Fuji Xerox Co., Ltd., Tokyo, Japan

[21] Appl. No.: 653,631

[22] Filed: May 24, 1996

[30] Foreign Application Priority Data

Aug. 31, 1995 [JP] Japan ..... 7-245227

[51] Int. Cl.[6] ..... G03G 15/20

[52] U.S. Cl. ..... 399/329; 399/330; 399/331

[58] Field of Search ..... 355/282, 285, 355/290; 399/329, 330, 331

[56] References Cited

FOREIGN PATENT DOCUMENTS

| | | |
|---|---|---|
| 58-198071 | 11/1983 | Japan . |
| 60-104981 | 6/1985 | Japan . |
| A-3-150585 | 6/1991 | Japan . |
| A-4-42187 | 2/1992 | Japan . |
| A-4-314555 | 11/1992 | Japan . |
| A-5-134590 | 5/1993 | Japan . |
| 6-75493 | 3/1994 | Japan . |
| 6-208314 | 7/1994 | Japan . |

*Primary Examiner*—Nestor R. Ramirez
*Attorney, Agent, or Firm*—Oliff & Berridge

[57] ABSTRACT

A fixing apparatus has two backup rollers which rotate while remaining in contact with the circumference of a pressing roller, and a plurality of roller bearings for pressing the pressing roller against a heating roller via the backup rollers. The roller bearings are set so as to forcefully press the portion in the vicinity of the center of the pressing roller compared to the portions around both ends of the pressing roller, via the backup roller. As a result, a pressing force acting between the pressing roller and the heating roller becomes substantially even in the axial direction of them, thereby resulting in an even nipping width. Further, the fixing apparatus may be provided with a cylindrical rotary pressing member and a substantially cylindrical pressed-contact member which is disposed in the rotary pressing member and presses it against the heating roller. The pressed-contact member may be formed so as to have a larger diameter at the center than at both ends thereof.

9 Claims, 6 Drawing Sheets

FIXING APPARATUS HAVING PRESSING MEMBERS

BACKGROUND OF THE INVENTION

1. Field of the Invention

This invention relates to a fixing apparatus for use in an electrographic image forming apparatus, such as a copier and facsimile, for fixing a toner image formed on a recording medium by heating and pressing.

2. Description of the Related Art

In a common electrographic image forming apparatus, a toner image is formed on an image carrier, and the thus formed toner image is transferred onto a recording medium such as paper. The recording medium having the toner image transferred thereon is guided to a fixing unit, and the toner image is fixed to the recording medium, thereby rendering the image permanent. For example, as shown in FIG. 4A, a commonly employed fixing unit is made up of a heating roller 101 and a pressing roller 102 disposed so as to come into pressed contact with the heating roller 101. The heating roller 101 comprises a cylindrical core metal 109, a heater 111 disposed inside the cylindrical core metal 109, and a heat-resistant resin coating layer 110 provided along the outer periphery of the cylindrical core metal 109. The pressing roller 102 comprises a cylindrical core metal 112 and a heat-resistant elastic layer 113 provided along the outer periphery of the cylindrical core metal 112. In this type of fixing unit, the heating roller 101 is supported at its both ends and is rotatively driven. Then, a recording medium 107 having a toner image 108 formed thereon is conveyed through a nipping area while being sandwiched between the heating roller 101 and the pressing roller 102. The recording medium 107 having the toner image 108 formed thereon is heated and pressurized while traveling through the nipping area. The toner fused by the heat is pressed and fixed to the recording medium 107. The fixing unit of this type has a higher heat efficiency compared to a fixing unit using hot air or an oven, and hence it is possible to fix an image at higher speed with lower electric power. Further, this type of the fixing unit involves a lower risk of a fire hazard from paper jams. For these reasons, the fixing unit of this type is now most extensively used.

However, it takes a longer warm-up period, e.g., one to ten minutes, for the above described fixing unit to increase the surface temperature of the heating roller 101 from room temperature to a preset temperature. This warm-up period is simply determined by the relationship between the heat capacity of the heating roller 101 and electric power used for heating the roller. In other words, if the heating roller 101 has a smaller heat capacity, and if large electric power is fed to heat the heating roller 101 , it will be possible to reduce the warm-up period. However, the heat capacity of the heating roller 101 is restricted by the rigidity thereof, and the electric power is also limited by the power consumption of the machine.

An electric power of 300 to 1000 W can be generally used as the power specially provided for fixing purposes. In order to reduce the warm-up period within this range of electric power, it is effective to reduce the heat capacity of the heating roller 101. If the outside diameter of the heating roller 101 and the thickness of the core metal 109 are reduced to decrease the heat capacity of the heating roller 101, the rigidity of the heating roller 101 is also reduced. The heat capacity of the heating roller 101 is proportional to the square of the diameter of the heating roller 101, while the rigidity of the heating roller is in proportion to the fourth power of the diameter of the heating roller 101. For this reason, the rigidity of the heating roller 101 suddenly drops if the diameter of the heating roller 101 is reduced to less than a predetermined value. If such a heating roller 101 is brought into pressed contact with the pressing roller 102 while they are supported at their both ends, the center axes of the rollers 101, 102 deflect away from each other into opposite directions, as being shown in FIG. 4B. Therefore, the nipping area of each of the rollers 101, 102 is unevenly formed so as to have a smallest nipping width at its longitudinal center and have a largest nipping width at both longitudinal ends thereof, as being shown in 4C. If paper having a toner image unfixed thereon passes through the nipping area having such an uneven shape, the paper will become crumpled up or offset will arise because of insufficient pressing strength acting on the center of the paper. As a result, the next paper is soiled, or the paper is missing an image.

On the assumption that a nip profile index of the center of the nipping area is defined as $c=a/b$ wherein "a" is a nipping width of the roller center and "b" is a nipping width at both ends of the roller, the nip profile index "c" becomes smaller than 1.0 for reasons of the deflection of the roller, as shown in FIG. 4c. In general, a value of 0.8 to 1.0 is optimum for "c" in terms of the consistency of the pressing strength and the prevention of crinkles of the paper.

In such a fixing unit, the nipping area between the pressing roller 102 and the heating roller 101 requires a pressure of about 0.5 to 5.0 $Kg/cm^2$. In the event that the nip pressure is less than that value, it will become impossible to fill uneven voids in the surface of the roller or paper, which makes it impossible to efficiently transfer heat to powdery toner. In which case, the toner surface becomes uneven after the toner has been fixed, thereby resulting in poor picture quality. For these reasons, it is necessary to impost a total load of 20 to 200 Kg to the nipping area between the rollers 101, 102 in order to ensure appropriate pressure.

If the heat capacity of the heating roller 101 is reduced to decrease the warm-up period in the manner as previously mentioned, the degree of the deflection of the rollers 101, 102, caused by a drop in the rigidity of the rollers 101, 102 when a necessary pressing force is introduced, increases. In turn, the value of "c" decreases outside the optimum range thereof. To prevent an unevenness of the nipping width, it is necessary to maintain the rigidity of the rollers 101, 102 so as to suppress the degree of the deflection of the rollers 101, 102 to less than a certain level, or it is necessary to correct the distribution of the pressing force of the rollers 101, 102. A value of about 0.1 mm is a guide for the minimum degree of the deflection. However, in many cases, it is difficult for a compact fixing unit to suppress the degree of the deflection less than this value.

Several techniques have already been proposed as means for correcting the distribution of the pressing force of the rollers. They are disclosed in, for example, Japanese Patent Laid-Open Nos. Hei 4-314555 (1992), 3-150585 (1991), 4-42187 (1992), and 5-134590 (1993).

In the case of a fixing unit as disclosed in Japanese Patent Laid-Open No. Hei 4-314555, a heating roller 121 and a pressing roller 122 are brought into pressed contact with each other at a predetermined inclined angle with respect to each other, as is shown in FIG. 5. Even if the rollers deflect, a relatively even nipping width will be maintained.

In the case of fixing units as disclosed in Japanese Patent Laid-Open Nos. Hei 3-150585, 4-42187, and 5-134590, a pressing roller 132 is supported in the vicinity of the longitudinal center thereof, as is shown in FIG. 6. The pressing roller 132 deflects responding to the deflection of the heating roller (not shown).

In the case of another fixing unit which has already been put forward, the pressing roller is formed so as to have a larger diameter at its longitudinal center than at both ends thereof, so that the nipping width between the heating roller and the pressing roller is rendered even.

In another fixing unit, as shown in FIG. 7, an auxiliary roller 143 supported at both ends thereof is disposed to press a pressing roller 142 against a heating roller 141, so that the degree of the deflection of the pressing roller 142 is reduced.

The above described conventional fixing units have the following problems.

In the case of the fixing unit as disclosed in Japanese Patent Laid-Open No. Hei 4-314555, it is possible to make the center nipping width close to the nipping width at both ends of the rollers so long as an angle of an intersection between the heating roller 121 and the pressing roller 122 is set to the optimum value. However, the rollers feed paper in respective different directions, which makes it impossible to prevent the paper from becoming crumpled up. Further, the paper becomes apt to curl up as a result of the fixing operation.

In the case of the fixing units as disclosed in Japanese Patent Laid-Open Nos. Hei 3-150585, 4-42187, and 5-134590, the heating roller and the pressing roller 132 deflect in a matched direction, whereby the nipping area can be rendered even to a certain extent. However, strictly speaking, the nipping width does not monotonously change but becomes wavy, thereby causing paper to become crumpled up. Machining of the pressing roller so as to be supported at its longitudinal center adds to roller costs. Further, such a construction of the roller causes an increase in the roller diameter, thereby rendering the unit bulky.

Where the pressing roller has a larger diameter at its center than at both ends thereof, it is possible to obtain an even nipping width with a simple structure. However, when paper is fed between the pressing roller and the heating roller, the paper becomes apt to become crumpled up because of a difference in surface speeds of the rollers caused by a difference in radii of the rollers in the axial direction thereof.

Where the deflection is corrected by pressing the pressing roller 142 using the auxiliary roller 143, the auxiliary roller 143 tends to curve in the opposite direction to the heating roller 141. It is impossible to inherently prevent the nipping width in the vicinity of the center between the heating roller and the pressing roller from becoming narrow.

SUMMARY OF THE INVENTION

The present invention is conceived to solve the above described drawbacks in the prior art, and the primary object of the present invention is to provide a fixing apparatus capable of preventing fixing failures and crinkles of paper by maintaining a substantially even nipping width between a heating roller and a pressing roller in their axial directions.

To this end, according to one aspect of the present invention, there is provided a fixing apparatus including a heating roller which is supported at its both ends and is rotatively driven, and a pressing roller which has substantially the same length as the heating roller and has the circumferential surface thereof brought into pressed contact with the heating roller in parallel, wherein a recording medium having a toner image transferred thereon is heated and pressurized between the heating roller and the pressing roller so that the toner image can be fused and fixed onto the recording medium, the fixing apparatus comprising: a backup roller which rotates while remaining in contact with the circumferential surface of the pressing roller; and a plurality of roller bearing members disposed so as to come into contact with the circumferential surface of the backup roller at intervals in the axial direction thereof for pressing the pressing roller against the heating roller via the backup roller, the roller bearing members being set in such a way as to more forcefully press the portion around the center of the pressing roller compared to the portions around the ends thereof, by way of the backup roller so that the pressing force acting between the pressing roller and the heating roller can become substantially even in the axial direction of the rollers.

The backup roller should preferably be made up of a plurality of rollers, and an angle θ between the center axis of the pressing roller and the center axes of the outermost backup rollers should preferably be set in the range of $60° \leqq \theta \leqq 130°$.

According to another aspect of the present invention, there is provided a fixing apparatus which heats and pressurizes a recording medium having a toner image transferred thereon so that the toner image can be fused and fixed onto the recording medium, the fixing apparatus comprising: a heating roller which is supported at both ends thereof and is rotatively driven; a cylindrical rotary pressing member which is brought into pressed contact with the heating roller; a pressed-contact member which is inserted into the rotary pressing member, which is supported at both ends thereof, and which presses the rotary pressing member against the heating roller, the pressed-contact member having a large diameter at the longitudinal center thereof compared to a diameter at both ends thereof so as to render the pressing force acting between the rotary pressing member and the heating roller substantially even in the axial direction of them.

Edge guide members should preferably be provided on both ends of the pressed-contact member for regulating the axial movement of the rotary pressing member.

Any arbitrarily selected material can be used for the rotary pressing member so long as the rotary pressing member is cylindrically formed. For instance, a cylindrical metal core having its outer periphery coated with a heat-resistant resilient substance, or an endless belt which possesses no substantial rigidity but retains a substantial cylindrical form even when it is not wrapped around a rotating member, may be used for the rotary pressing member. Although the rotary pressing member may be simply sandwiched between the heating roller and the pressed-contact member, it is desirable to provide the rotary pressing member with a swing regulation member which comes into contact with the outer or internal periphery of the rotary pressing member to prevent the rotary pressing member from swinging around a nipping area when it rotates.

The circumference of each end of the cylindrical rotary pressing member should preferably be set to 1.005 to 1.02 times the circumference of the center thereof so as to prevent to a much greater extent paper becoming crumpled.

There is no need to bring the pressed-contact member into contact with the entire width of the rotary pressing member so long as the rotary pressing member possesses rigidity. The pressed-contact member may be formed into a roller which includes larger diametrical portions made of protuberances axially arranged at intervals.

According to one aspect of the present invention, the fixing apparatus is provided with a backup roller which rotates while remaining in contact with the circumferential surface of the pressing roller and the roller bearing members for pressing the backup roller, so that the roller bearings press the pressing roller against the heating roller via the backup roller. The roller bearing members are set so as to more forcefully press the portion in the vicinity of the longitudinal center of the pressing roller via the backup roller. The center portion of the backup roller convexly deflects, and the associated pressing roller presses the heating roller while it is also in a convexly deflected state. Accordingly, the heating roller, the pressing roller, and the backup roller deflect all in the same direction. The pressing force acting between the pressing roller and the heating roller becomes substantially even in the axial direction of the rollers. Even if the pressing roller and the backup roller possess smaller flexural rigidity, the nipping width between the pressing roller and the heating roller becomes substantially even, which in turn prevents fixing failures. Moreover, the peripheral speed of the heating roller is substantially even in the axial direction of the roller, and hence the paper is prevented from becoming crumpled up when it is subjected to a fixing operation.

The fixing apparatus is provided with the plurality of backup rollers disposed at suitable positions with respect to the pressing roller. The pressing roller is pressed against the heating roller by means of these backup rollers, which prevents the pressing roller from deflecting in the paper feeding direction as a result of the use of the roller over a long period of time. Therefore, an even pressing force is ensured between the pressing roller and the heating roller in the axial direction of the rollers over a long period of time, which reliably prevents fixing failures and paper crumples.

According to another aspect of the present invention, the above described fixing apparatus is provided with the cylindrical rotary pressing member having the even circumference in its axial direction, and the pressed-contact member disposed inside the cylindrical rotary pressing member for supporting the same. By means of the pressing force of the pressed-contact member, the rotary pressing member is pressed against the heating roller. This pressed-contact member has the longitudinal center thereof diametrically enlarged compared to both ends thereof. As a result, even if the portion in the vicinity of the center of the heating roller that receives the pressing force concavely deflects, the rotary pressing member assume a form responding to the profile of the warped heating roller. Consequently, the pressing force acting between the rotary pressing member and the heating roller is maintained substantially even in their axial direction. In turn, the nipping width between the rotary pressing member and the heating roller becomes substantially even in their axial direction, which prevents fixing failures. Further, the peripheral speed of the rotary pressing member becomes substantially even in the axial direction of the rotary pressing member, and therefore paper is suitably fed, thereby preventing the paper from being crumpled up.

The edge guide members are provided on both sides of the pressed-contact member for regulating the axial movement of the rotary pressing member. The rotation of the rotary pressing member together with the heating member prevents the axial movement of the rotary pressing member. As a consequence, the rotation of the rotary pressing member becomes stable, and the direction in which the paper is fed is appropriately maintained, thereby preventing fixing failures and paper crumples.

DESCRIPTION OF THE PREFERRED EMBODIMENTS

With reference to the accompanying drawings, preferred embodiments of the present invention will be described hereinbelow.

Figure 1A:
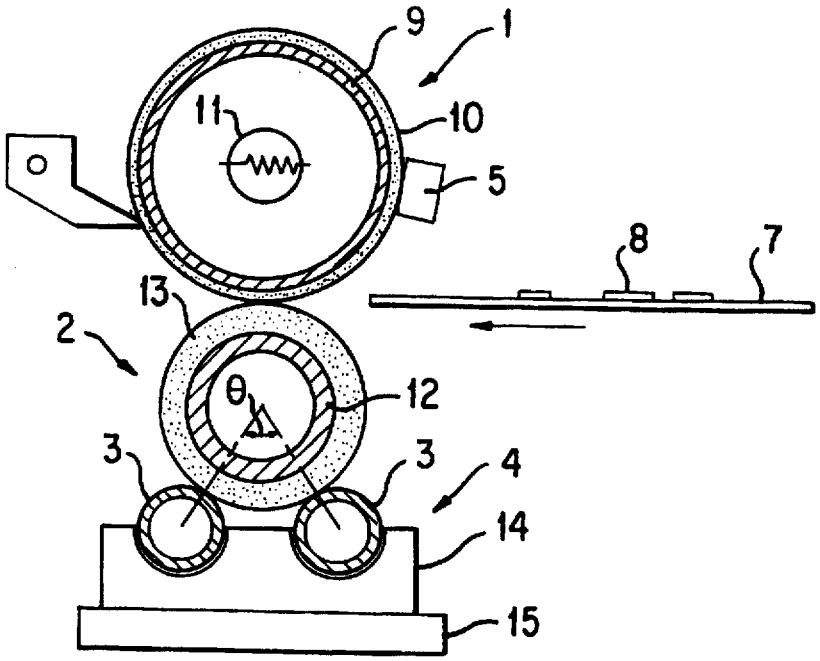
FIGS. 1A and 1B are schematic representations of a fixing apparatus according to one embodiment of the present invention.
Figure 1B:
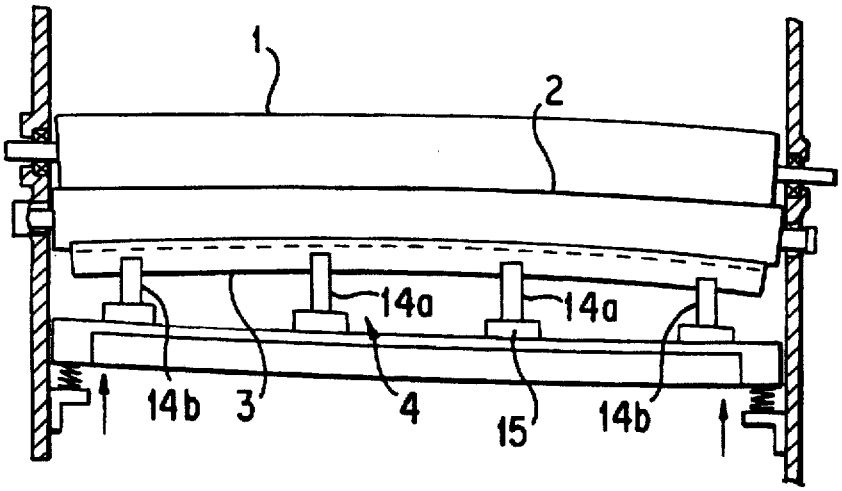

FIGS. 1A and 1B are schematic representations showing the construction of a fixing apparatus according to one embodiment of the present invention.

The fixing apparatus is provided with a heating roller 1 for heating recording paper 7 having a toner image 8 transferred thereon, a pressing roller 2 which rotates responding to the heating roller 1 while remaining in pressed contact with the same, two backup rollers 3 which rotate while remaining in contact with the circumferential surface of the pressing roller 2, and roller bearing members 4 for pressing the pressing roller 2 against the heating roller 1 via the backup rollers 3.

The fixing apparatus is further provided with a paper guide (not shown) for guiding the recording paper 7 having the toner image 8 transferred thereon to a contact area (a nipping area) between the heating roller 1 and the pressing roller 2, and a conveyor roller (not shown) for conveying the recording paper 7 having finished passing through the nipping area.

The heating roller 1 is made up of a cylindrical core metal 9 and a releasing layer 10 which consists of fluorocarbon polymers (Teflon, i.e., the registered trademark of E.I. Du Pont de Nemours & Co.) and covers the core metal to a thickness of about 0.3 mm. A heater 11 is disposed in the core metal 9 for heating the recording paper. As shown in FIG. 1B, the core metal 9 is supported at its both ends, and it is rotated at a peripheral speed of about 250 mm/s with a drive source (not shown). The core metal 9 is made of iron, and it measures 30 mm in diameter, 0.3 mm in thickness, and 325 mm in length. The heater 11 is made of a 100-volt and 1000 watts infrared ray lamp, and the heater is fixedly supported within the core metal 9. A temperature sensor 5 is disposed adjacent to the heating roller 1 for detecting the temperature of the heating roller 1, and the ON-OFF control of the heater 11 is carried out based on the result of the detection. With this arrangement, the heater is controlled to maintain the surface temperature of the heating roller 1 at a temperature of about 150° C. Further, this heating roller 1 requires a warm-up period of about ten seconds.

The pressing roller 2 is made of a cylindrical member 12 coated with a silicon rubber layer 13. The cylindrical member 12 is made of a stainless steel core, and it measures 15 mm in outside diameter and 320 mm in length. The silicon rubber layer 13 has a thickness of 5.0 mm, and the diameter of the pressing roller 2 is set to about 25 mm.

The backup rollers 3 rotate responding to the rotation of the pressing roller 2, and they are made of a stainless steel pipe measuring 8 mm in outside diameter, 7.5 mm in inside diameter, and 320 mm in length. An angle θ Θ between the axis of the pressing roller 2 and the axes of the two backup rollers 3 is set to 100°.

As shown in FIG. 1B, the four roller bearing members 4 are disposed at even intervals so as to press the two backup rollers 3. The roller bearing member 4 is made up of pressing members **14*a* and 14*b* for supporting the backup rollers 3 and a base 15 for fixing the pressing members 14*a* and 14*b*. With this arrangement, the pressing roller 2 is pressed against the heating roller 1 via the backup rollers 3. Both ends of the backup rollers 3 are not axially supported, but they are sandwiched between the roller bearing members 4 and the pressing roller 2. The two pressing members 14*a* of the roller bearing members 4 positioned in the vicinity of the longitudinal center are formed higher than the other two pressing members. 14*b* so as to set the pressing force acting on the center and its surrounding area of the backup rollers 3 larger than the pressing force acting on both ends of the backup rollers 3. In the present embodiment, the roller bearing members 4 are disposed at an interval of 100 mm, and the total load acting from the backup rollers 3 to the heating roller 1 via the pressing roller 2 is set to about 50 kg. Specifically, each of the two center pressing members 14*a* imposes a load of 15 kg to the backup rollers 3, whereas each of the other two pressing members 14*b* located around both ends of the backup rollers 3 imposes a load of 10 kg to the backup rollers 3**.

In the fixing apparatus having the above described construction, a load is imposed from the backup rollers 3 to the heating roller 1 via the pressing roller 2, and the heating roller 1 convexly deflects upon receipt of the pressing force from the pressing roller 2. In this event, the distribution of the load imposed from the backup rollers 3 is set so as to become larger toward the center from both ends of the rollers by means of the roller bearing members 4. For this reason, the backup rollers 3 convexly deflect to a suitable extent, which in turn presses the pressing roller 2. Responding to the deflection of the backup rollers, the pressing roller 2 also convexly deflects. As a result, the heating roller 1, the pressing roller 2, and the backup rollers 3 deflect in the identical direction, as being shown in FIG. 1B, and the heating roller 1 and the pressing roller 2 assume substantially the identical warp. Therefore, the pressing force acting between the pressing roller 2 and the heating roller 1 becomes substantially even in the axial direction of the rollers, and it becomes possible to obtain a substantially even nipping width in the axial direction of the rollers.

If the heating roller 1 deflects more than 0.1 mm as a result of the deflection of the heating roller 1 and the pressing roller 2 in the identical direction, it is possible to maintain a substantially even nipping width, which in turn makes it possible to significantly increase the deflection limit of the heating roller 1. Even if the heating roller 1, the pressing roller 2, and the backup rollers 3 possess small flexural rigidity, it is possible to ensure the even nipping width. As a result, a smaller fixing apparatus can be implemented by reducing the outside diameter of each of the rollers and the thickness of the respective members. Since it is possible for a compact fixing apparatus to obtain a relatively large pressing force, it is possible to achieve a fixing apparatus which sufficiently satisfies high-speed fixing performance without fixing failures and paper crumples. Further, the heat capacity of each roller can be reduced to a very smaller capacity, and therefore it is possible to significantly reduce the warm-up period and to prevent a sharp drop in the temperature of the heating roller 1 as a result of the heating roller 1 being deprived of heat by the pressing roller 2 or the backup rollers 3. The backup rollers 3 and the pressing roller 2 are fully in contact with each other over the entire axial length thereof, which in turn makes it easy to render the temperature distribution of the heating roller 1 even. For this reason, the edges of the backup rollers 3 will not damage the surface of the pressing roller 2.

In the above described fixing apparatus, the two backup rollers 3 disposed in suitable positions press the pressing roller 2 against the heating roller 1. As a result, the pressing roller 2 can be prevented from deflecting in the direction in which paper is fed even when it is used over a long period of time. The pressing force acting between the pressing roller 2 and the heating roller 1 becomes substantially even in the axial direction of the rollers 1, 2 over a long period of time.

Practical measurement of the profile of the nipping area between the heating roller 1 and the pressing roller 2, resulted in the nipping area measuring 6.5 mm around both ends of the rollers 1, 2 and 6.0 mm at the center thereof. The nip profile index obtained at that time was 0.92, and hence a desirable nipping width was obtained. A test for the fixing of the toner image on PPC paper using the fixing apparatus was carried out. This test, produced neither fixing failures nor paper crumples.

Figure 4A:
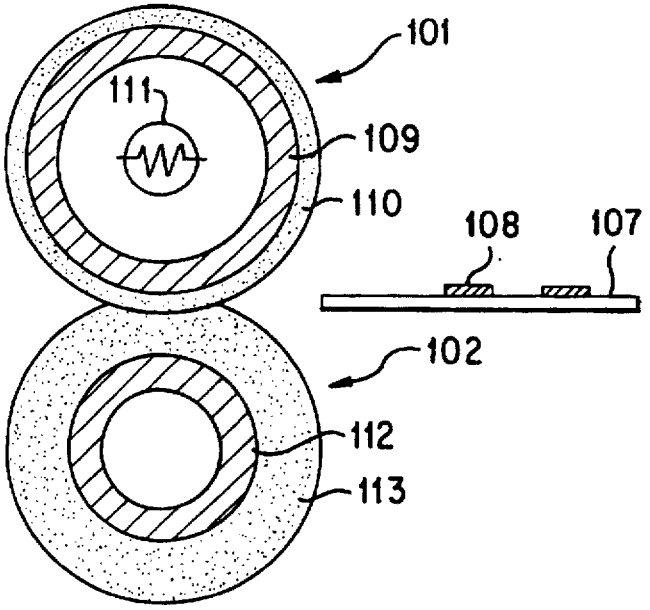
FIG. 4(A) PRIOR ART
FIG. 4A is a diagrammatic side view of a first exemplary conventional fixing unit.
Figure 4B:
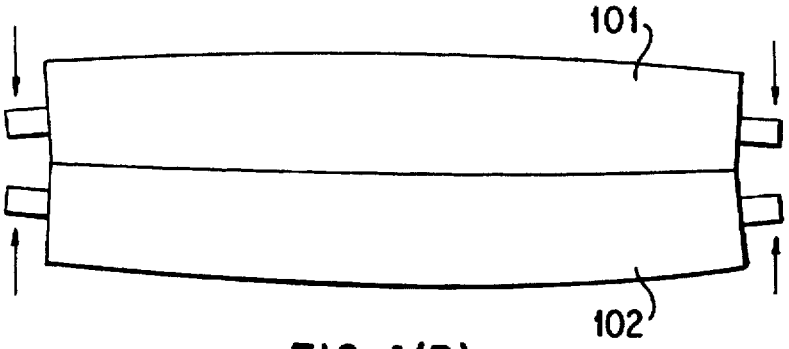
FIG. 4(B) PRIOR ART
FIG. 4B is a schematic representation showing a heating roller and a pressing roller of the fixing apparatus shown in FIG. 4A when they are in a deflected state.
Figure 4C:
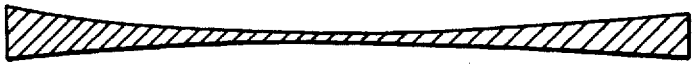
FIG. 4(C) PRIOR ART
FIG. 4C is a schematic representation showing a nipping area between the heating roller and the pressing roller.
Figure 5:
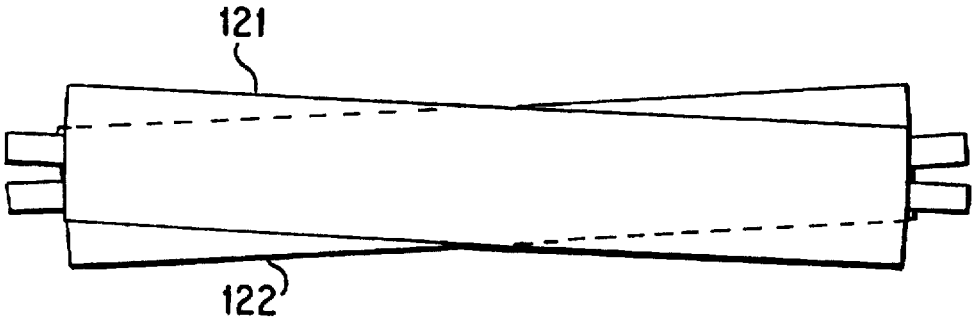
FIG. 5 PRIOR ART
FIG. 5 is a schematic representation of a second exemplary conventional fixing apparatus showing a heating roller and a fixing roller.
Figure 6:
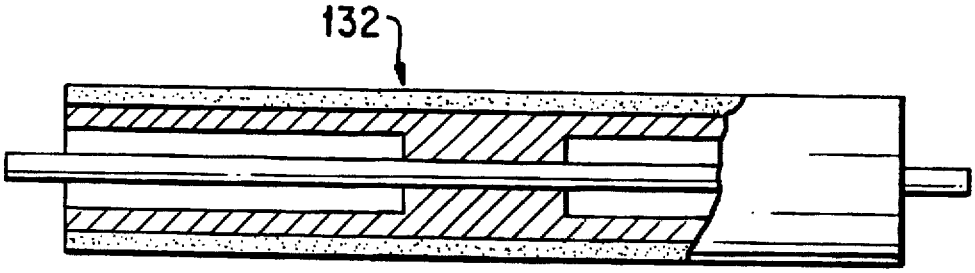
FIG. 6 PRIOR ART
FIG. 6 is a diagrammatic partial cross section of a pressing roller used in a third exemplary conventional fixing unit.
Figure 7:
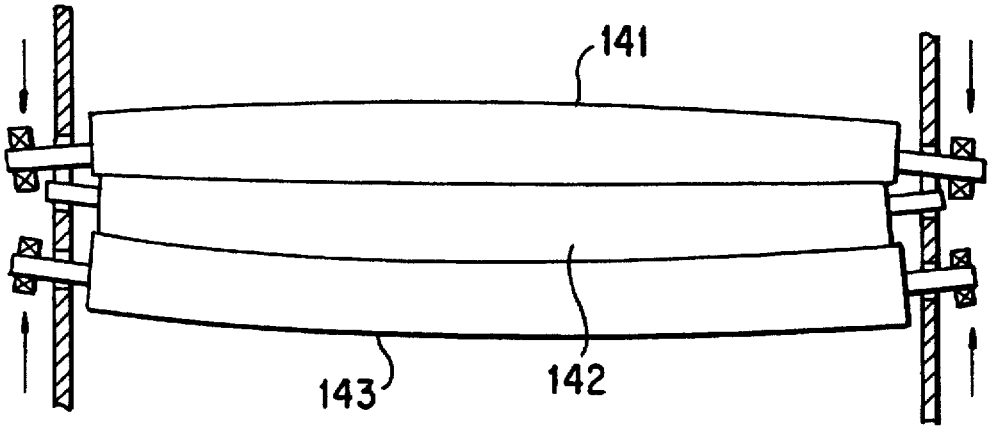
FIG. 7 PRIOR ART
FIG. 7 is a schematic representation of a fourth exemplary conventional fixing unit showing a heating roller, a pressing roller, and a backup roller.

For comparison and to demonstrate the effect of the fixing apparatus, the measurement of the nipping width and the test for the fixing of the toner image were similarly carried out by use of heating and pressing rollers having the same diameter and thickness as described above, without the use of the backup rollers, and providing the identical load, i.e., a load of 50 kg, imposed between the heating roller 101 and the pressing roller 102 from both sides of the fixing unit as shown in FIG. 4B. In this case, the rollers 101, 102 of the conventional fixing unit deflected in opposite directions. The resultant nipping width was 7.2 mm at both ends of the nipping area and 4.5 mm at the center of the same. The nip profile index obtained at this time was 0.63. The paper became crumpled up when it was subjected to the fixing operation, and fixing failures occurred in the vicinity of the center of the paper.

Figure 2A:
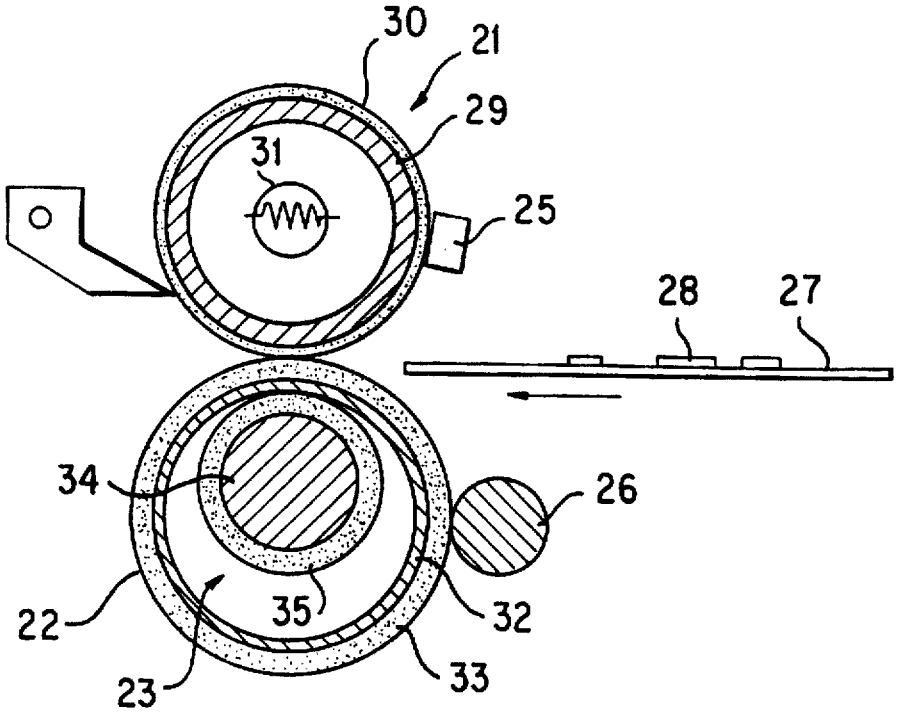
FIGS. 2A and 2B are schematic representations of a fixing unit according to another embodiment of the present invention.
Figure 2B:
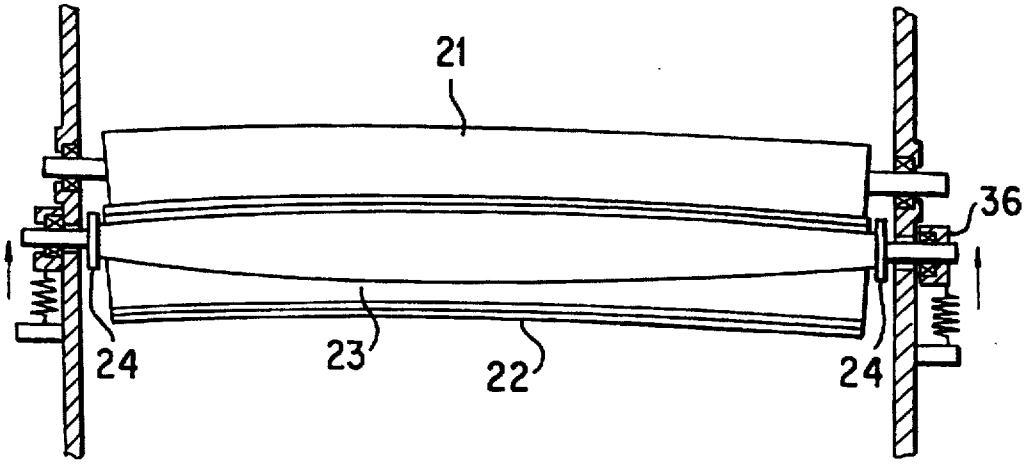

FIGS. 2A and 2B are schematic representations of a fixing apparatus according to another embodiment of the present invention.

Instead of the pressing roller 2 and the backup rollers 3 of the fixing apparatus shown in FIGS. 1A and 1B, the fixing apparatus of this embodiment is provided with a rotary pressing member 22 which is made of a cylindrical member having an even circumference in the axial direction thereof, and a pressed-contact member 23 inserted into the rotary pressing member 22 so as to press the rotary pressing member 22 against a heating roller 21. A swing regulating member 26 is further provided so as to come into contact with the circumferential surface of the rotary pressing member 22 for stabilizing the rotation of the rotary pressing member.

The rotary pressing member 22 is made of a stainless steel core 32 which measures 30 mm in outside diameter, 0.2 mm in thickness, and 310 mm in length. The stainless steel core 32 is coated with a silicon rubber layer 33 having a thickness of 2.0 mm.

As shown in FIG. 2B, the pressed-contact member 23 is made of a roller which has a larger diameter at its center compared to both ends of. The rotary pressing member 22 is supported by bearings 36 provided on both sides of the pressed-contact member 23 so that it can be brought into contact with the heating roller 21. The pressed-contact member 23 is made of a stainless steel core 34 which measures 20 mm in outside diameter and 320 mm in length. The stainless steel core 34 is coated with a silicon rubber layer 35 having a thickness of 1.6 mm at the center and a thickness of 1.0 mm at both ends. A total load of 50 kg is imposed from the bearings 36 to the pressed-contact contact member 23. Edge guide members 24 are provided on both sides of the pressed-contact member 23 so as to come into contact with the edges of the rotary pressing member 22 for regulating the axial movement thereof.

The heating roller 21 has contractually the same construction as the heating roller shown in FIGS. 1A and 1B. Specifically, the heating roller 21 is made up of an iron core 29 which measures 35 mm in diameter, 0.2 mm in thickness, and 335 mm in length. The iron core 29 is coated with a releasing layer 30 having a thickness of about 0.3 mm. The fixing apparatus of the present embodiment is the same as that of the fixing apparatus shown in FIGS. 1A and 1B, except for the above described members.

In the fixing apparatus having the above described construction, the rotary pressing member 22 is pressed against the heating roller 21 by means of the pressed-contact member 23. The heating roller 21 deflects by about 0.4 mm. In this event, the pressed-contact member 23 has an enlarged diameter at the center thereof allowing for the amount of deflection of the heating roller 21 and the rigidity of the rotary pressing member 22. By virtue of this arrangement, the rotary pressing member 22 deflects corresponding to the warp of the heating roller 21, which makes it possible to obtain a substantially even nipping width. Compared with the conventional deflection limit of 0.1 mm, the amount of deflection of the heating roller 21 is relatively large. However, the nipping width around both sides of the roller is 6.0 mm, and the nipping width at the center of the roller is 5.4 mm. The nip profile index is 0.9.

Figure 8A:
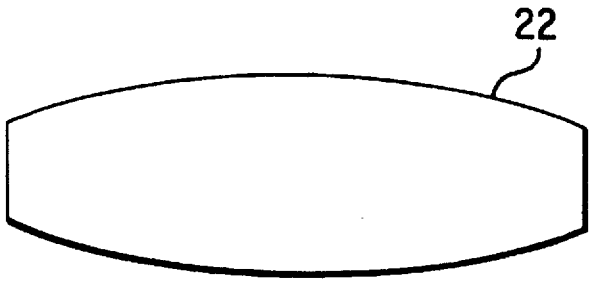
FIG. 8(A) is a schematic representation of a rotary pressing member where the circumference of the ends of the member is smaller than at the center.
Figure 8B:
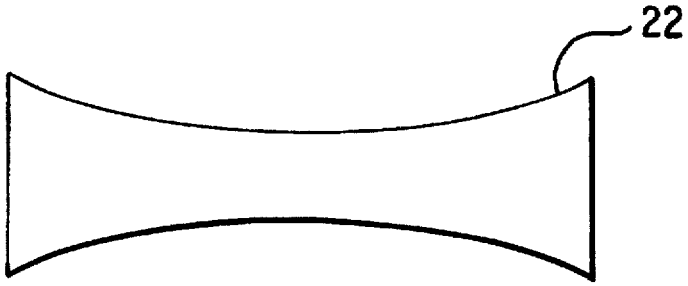
FIG. 8(B) is a schematic representation of a rotary pressing member where the circumference of the ends of the member is larger than at the center.

In the current embodiment, a case where the rotary pressing member 22 has a longitudinally uniform diameter has been mentioned. However, the form of the rotary pressing member 22 may be intentionally non-uniform: for example, a crown-type roller having a larger diameter at the longitudinal center thereof than at both ends thereof, as shown in FIG. 8(*a*) or a flare-type roller having larger diameters at both ends thereof than at the longitudinal center thereof, as shown in FIG. 8(*b*) may be used as the rotary pressing member. In such case, it is necessary that the circumference of each end of the rotary pressing member is within a range of 0.98 to 1.02 times the circumference of the center thereof to render the nipping width uniform and prevent insufficient fixing and paper crumple.

For instance, if the heating roller extremely deflects, use of the crown-type roller enables a smaller increase of the diameter of the longitudinal center of the pressed-contact member compared to the ends of the pressed-contact member, while still absorbing the influence of the deflection and obtaining a uniform nip width. However, in this case, paper crumple occurs in the direction vertical to the axial direction of the heating roller if the circumference at each end of the rotary pressing member is less than 0.98 times the circumference at the longitudinal center thereof.

In the case where the flare-type rotary pressing member is employed, the increase of the diameter of the longitudinal center of the pressed-contact member as compared to the ends of the pressed-contact member should be larger than in the case where the rotary pressing member of uniform diameter is used. However, in this case, paper crumple occurs in the direction parallel with the axial direction of the heating roller if the circumference at each end of the rotary pressing member is more than 1.02 times of the circumference at the longitudinal center thereof.

When the paper having an unfixed toner image formed thereon was fixed using the fixing apparatus having the above construction, the image was sufficiently fixed, and the paper did not become crumpled at all. The swing regulation member 26 stabilizes the rotation of the rotary pressing member 22, and hence the pressing force acting between the rotary pressing member and the heating roller 21 becomes more even. As a result, it is possible to more reliably ensure the prevention of fixing failures. Further, the edge guide members 24 regulate the axial movement of the rotary pressing member 22, and hence it is possible to stably maintain the nipping width and the paper feeding direction over a long period of time.

Accordingly, the fixing apparatus can render the nipping area substantially even in the axial direction of the roller without increasing the rigidity of the heating roller and the pressed-contact member. Compared with the conventional fixing unit, it becomes possible to reduce the warm-up period. It is also possible to reduce the size, weight, and cost of the fixing apparatus.

For comparison with the effect of the fixing apparatus of the present embodiment, the heating roller 101 that is identical with the heating roller used in the above embodiment 21 was pressed by the conventional pressing roller 102 as shown in FIGS. 4A and 4B. The heating roller 101 reached the deflection limit of 0.1 mm under a load of 8 kg. The nipping width at both ends of the rollers was 3.5 mm, and the nipping width at the center of the rollers was 2.8 mm. The nip profile index was 0.80. When the unfixed toner image was fixed using such a fixing unit, neither fixing failures nor paper crumples substantially occurred. However, when the load was increased up to 10 kg, the amount of deflection of the roller reached 0.13 mm, and the nip profile index became 0.78. Further, a number of crumples developed in the transverse direction of the paper. For these reasons, a load of 8 kg and a fixing rate of 100 m/sec were the limits for the above described comparative example. It is acknowledged that the fixing unit of this comparative example cannot be used with a high speed image forming apparatus.

Figure 3A:
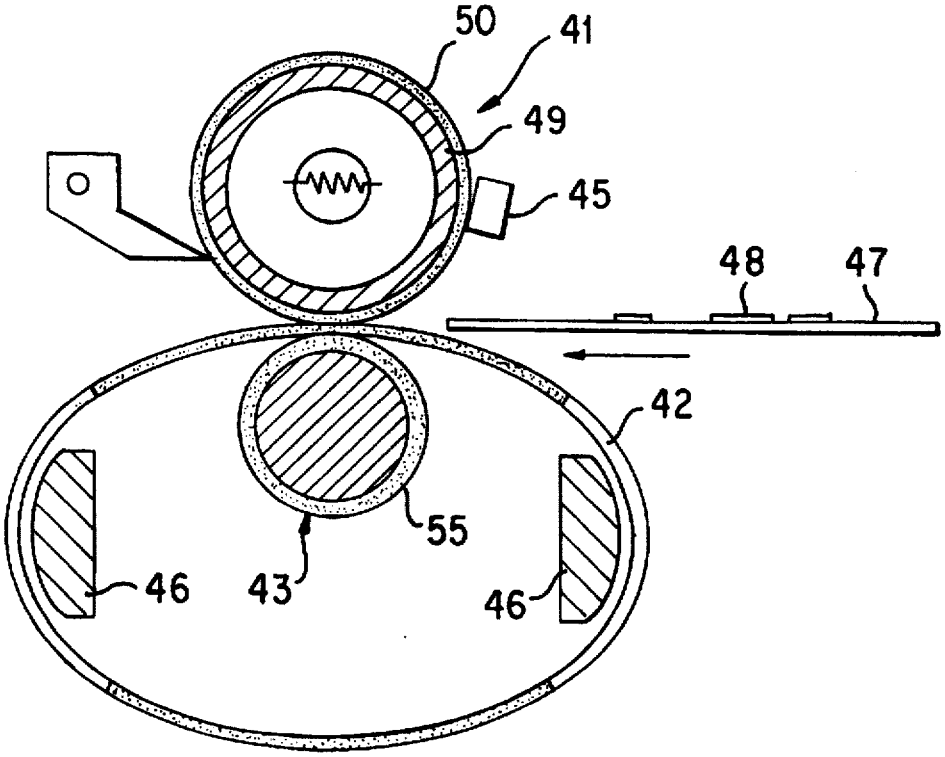
FIGS. 3A and 3B are schematic representations of a fixing apparatus according to still another embodiment of the present invention.
Figure 3B:
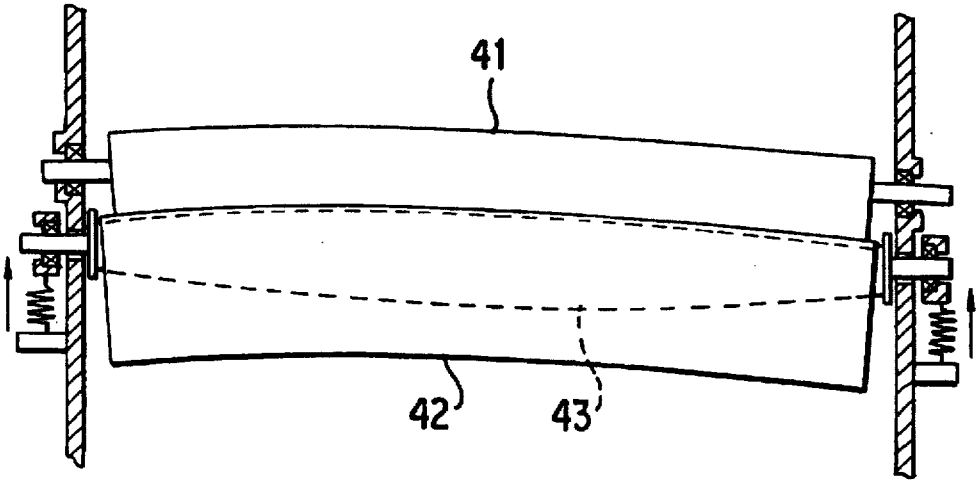

FIGS. 3A and 3B are schematic representations of a fixing apparatus according to still another embodiment of the present invention.

Instead of the rotary pressing member 22 and the swing regulation member 26 of the fixing apparatus shown in FIGS. 2A and 2B, the fixing apparatus of this embodiment is provided with a rotary pressing member 42 which consists of an endless belt having small flexural rigidity, and guide members 46 brought into contact with the internal peripheral surface of the rotary pressing member 42 for stabilizing the rotation of the rotary pressing member 42. As with the fixing apparatus shown in FIGS. 2A and 2B, a pressed-contact member 43 is disposed in the rotary pressing member 42 for pressing the rotary pressing member 42 against a heating roller 41.

The rotary pressing member 42 comprises an endless belt which is formed from nickel and measures 0.3 mm in thickness, 95 mm in circumference, and 310 mm in width. The endless belt is coated with a silicon rubber layer having a thickness of 0.03 mm. This rotary pressing member 42 possesses no substantial flexural rigidity, but it can rotate while retaining a substantial cylindrical shape without imparting a tension to the belt. The guide members 46 regulate the shape of the rotary pressing member 42.

The pressed-contact member 43 is made up of a stainless steel core which measures 20 mm in outside diameter and 320 mm in length. The stainless steel core is coated with a silicon rubber 55 which has a thickness of 1.0 mm at both ends but has a thickness of 1.4 mm at the center. The fixing apparatus of the present embodiment has the identical construction with the fixing apparatus as shown in FIGS. 2A and 2B, except for the above members.

The nip profile index between the heating roller 41 and the rotary pressing member 42 of the fixing apparatus of this embodiment was 0.95. The image could be sufficiently fixed even when the rollers were rotated at a speed of 250 mm/s. The guide members 46 brought into contact with the internal peripheral surface of the rotary pressing member 42 contributed to stabilizing the rotation of the rotary pressing member 42, which could reliably prevent the paper from becoming crumpled. A reduction in the size of the fixing apparatus and a considerable reduction of the warm-up period were achieved. It is possible for this fixing apparatus to cope with a high speed image forming apparatus with a simple construction.

As described above, the roller bearing members 4 of the fixing apparatus according to the first embodiment are set so as to more forcefully press the portion in the vicinity of the center of the pressing roller 2 via the backup rollers 3 compared to the areas around both ends of the pressing roller 2. Hence, the heating roller 1, the pressing roller 2, and the backup rollers 3 deflect in the identical direction, and the pressing force acting between the heating roller 1 and the pressing roller 2 becomes substantially even along the axial direction of the rollers. As a result, the nipping width of the pressing roller 2 and the heating roller 1 becomes substantially even, which makes it possible to prevent fixing failures. Further, the peripheral speed of the pressing roller 2 also becomes substantially even in the axial direction thereof, which makes it possible to prevent the paper from becoming crumpled. The rigidity of the pressing roller 2 and the backup rollers 3 can be reduced, and hence it is possible to implement a compact fixing apparatus with a simple construction. Further, it is possible to reduce heat loss of the heating roller 1.

In the fixing apparatus of the present invention, the pressing roller 2 is pressed against the heating roller 1 by means of the two backup rollers 3 disposed at suitable locations. As a result, the pressing roller 2 is prevented from deflecting in the direction in which the paper is fed, and hence it is possible to retain a substantially even pressing force between the pressing roller 2 and the heating roller 1. For these reasons, neither fixing failures nor paper crumples arise even if the fixing apparatus is used over a long period of time, which makes it possible to implement a highly reliable fixing apparatus.

In the fixing apparatus according to the second embodiment of the present invention, the pressed-contact member 23 which presses the rotary pressing member 22 against the heating roller 21 is formed so as to have a larger diameter at the longitudinal center than at both ends thereof. As a result, even if the heating roller 21 deflects, the pressing force acting between the rotary pressing member 22 and the heating roller 21 is retained at a substantially even level. The nipping width can be made substantially even in the axial direction of the rollers. As a result, it is possible to prevent fixing failures, and the peripheral speed of the rotary pressing member becomes substantially even in the axial direction thereof. For this reason, the paper can be prevented from becoming crumpled. Further, a compact fixing apparatus can be implemented by means of a simple construction, and the heat loss of the heating roller can be reduced.

In the above described fixing apparatus, the axial movement of the rotary pressing member 22 is regulated by the edge guide members 24, and therefore the rotation of the rotary pressing member 22 can be stabilized. As a result, the pressing force acting between the rotary pressing member 22 and the heating roller 21 is evenly maintained to a much greater extent. Further, the direction in which the paper is fed can be appropriately maintained and it is possible to more reliably prevent fixing failures and paper crumples.

What is claimed is:

1. A fixing apparatus which heats and pressurizes a recording medium having a toner image transferred thereon so that the toner image can be fused and fixed onto the recording medium, said fixing apparatus comprising:

a heating roller for heating the recording medium;

a rotary driving means for rotating the heating roller;

a cylindrical rotary pressing member disposed opposite to the heating roller with the recording medium between them, a circumference of each end of the cylindrical rotary pressing member being set to 0.98 to 1.02 times as large as the circumference of a center thereof such that the circumference of each end of the cylindrical rotary pressing member is different from the circumference of the center thereof; and a pressed-contact member inserted into the cylindrical rotary pressing member for pressing the cylindrical rotary pressing member against the heating roller, the pressed-contact member having a larger diameter at the longitudinal center thereof than at both ends thereof so as to render a pressing force acting between the rotary pressing member and the heating roller substantially even in the axial direction of them.

2. A fixing apparatus as defined in claim 1, further comprising edge guide members for regulating axial movement of the cylindrical rotary pressing member.

3. A fixing apparatus which heats and pressurizes a recording medium having a toner image transferred thereon so that the toner image can be fused and fixed onto the recording medium, said fixing apparatus comprising:

a heating roller for heating the recording medium;

rotary driving means for rotating the heating roller;

a pressing roller disposed opposite to the heating roller with the recording paper between them;

a backup roller which rotates while remaining in contact with the circumference of the pressing roller;

a roller bearing member which comes into contact with the circumference of the backup roller and presses the backup roller so that the heating roller, the pressing roller, and the backup roller can deflect in an identical direction; and wherein the roller bearing member comprises at least two roller bearings, and they are in contact with areas around both ends and the center of the circumference of the backup roller.

4. A fixing apparatus as defined in claim 3, wherein the backup roller is made up of two rollers, and an angle θ between the center axis of the pressing roller and the center axes of the backup rollers is set in the range of $60° \leqq \theta \leqq 130°$.

5. A fixing apparatus which heats and pressurizes a recording medium having a toner image transferred thereon so that the toner image can be fused and fixed onto the recording medium, said fixing apparatus comprising:

a heating roller for heating the recording medium;

rotary driving means for rotating the heating roller;

a pressing roller disposed opposite to the heating roller with the recording paper between them;

a backup roller which rotates while remaining in contact with the circumference of the pressing roller; and a plurality of roller bearing members disposed so as to come into contact with the circumferential surface of the backup roller at intervals in the axial direction thereof for pressing the pressing roller against the heating roller via the backup roller, said roller bearing members being set in such a way as to more forcefully press the portion around the center of the pressing roller compared to the portions around the ends thereof, by way of the backup roller so that a pressing force acting between the pressing roller and the heating roller can become substantially even in the axial direction of the rollers.

6. A fixing apparatus as defined in claim 5, wherein the roller bearing members are in contact with areas around both ends and the center of the circumference of the backup roller.

7. A fixing apparatus as defined in claim 5, wherein the backup roller is made up of two rollers, and an angle θ between the center axis of the pressing roller and the center axes of the backup rollers is set in the range of $60° \leqq \theta \leqq 130°$.

8. A fixing apparatus which heats and pressurizes a recording medium having a toner image transferred thereon so that the toner image can be fused and fixed onto the recording medium, said fixing apparatus comprising:

a heating roller for heating the recording medium;

rotary driving means for rotating the heating roller;

a cylindrical rotary pressing member disposed opposite to the heating roller with the recording medium between them;

edge guide members for regulating axial movement of the cylindrical rotary pressing member; and a pressed-contact member inserted into the cylindrical rotary pressing member for pressing the cylindrical rotary pressing member against the heating roller, the pressed-contact member having a larger diameter at the longitudinal center thereof than at both ends thereof so as to render a pressing force acting between the rotary pressing member and the heating roller substantially even in the axial direction of them.

9. A fixing apparatus as defined in claim 8, wherein a circumference of each end of the cylindrical rotary pressing member is set to 0.98 to 1.02 times as long as a circumference of a center thereof.

* * * * *